US010894283B2

(12) United States Patent
Nakamura et al.

(10) Patent No.: US 10,894,283 B2
(45) Date of Patent: Jan. 19, 2021

(54) MOLDED MATERIAL PRODUCTION METHOD AND MOLDED MATERIAL

(71) Applicant: Nisshin Steel Co. Ltd., Tokyo (JP)

(72) Inventors: Naofumi Nakamura, Tokyo (JP); Yudai Yamamoto, Tokyo (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 16/078,380

(22) PCT Filed: Feb. 21, 2017

(86) PCT No.: PCT/JP2017/006364
§ 371 (c)(1),
(2) Date: Aug. 21, 2018

(87) PCT Pub. No.: WO2017/146045
PCT Pub. Date: Aug. 31, 2017

(65) Prior Publication Data

US 2019/0283101 A1 Sep. 19, 2019

(30) Foreign Application Priority Data

Feb. 24, 2016 (JP) ..... 2016-033361

(51) Int. Cl.
*B21D 22/28* (2006.01)
*B21D 22/21* (2006.01)
(Continued)

(52) U.S. Cl.
CPC ..... *B21D 22/28* (2013.01); *B21D 22/21* (2013.01); *B21D 22/22* (2013.01); *B21D 24/02* (2013.01)

(58) Field of Classification Search
CPC ..... B21D 22/20; B21D 22/21; B21D 22/28; B21D 22/30; B21D 24/02; B21D 25/02
(Continued)

(56) References Cited

U.S. PATENT DOCUMENTS 5,179,854 A * 1/1993 Matsui ..... B21D 22/28 72/349
6,755,068 B2 * 6/2004 Miyauchi ..... B21D 22/30 72/347
(Continued)

FOREIGN PATENT DOCUMENTS

JP 57-159224 10/1982
JP 2013-051765 3/2013
(Continued)

OTHER PUBLICATIONS

English translation of the International Preliminary Report on Patentability, counterpart International Appl. No. PCT/JP2017/006364, dated Sep. 7, 2018 (6 pages).
Murakawa et al., Basics of Plastic Processing, First Edition, Sangyo-Tosho Publishing Co. Ltd., pp. 104-107, with English translation (Jan. 16, 1990) (12 pages).
(Continued)

*Primary Examiner* — Teresa M Ekiert
(74) *Attorney, Agent, or Firm* — Cook Alex Ltd.

(57) ABSTRACT

Provided are: a method for producing a molded material comprising tubular body and a flange formed at an end portion of the body; and a molded material produced thereby, which can prevent the flange of the molded material becoming unnecessarily thick, avoid the generation of wrinkles and buckling, and allow weight reduction of the molded material and size reduction of a base metal sheet. When producing the molded material by molding processes including at least one drawing-out process and at least one drawing process performed after the drawing-out process, a first drawing process is carried out on a region corresponding to the body while opening a die and a drawing sleeve, and an ironing process is carried out on a region corresponding to the flange while keeping a constant interval of a mold gap between the die and the drawing sleeve.

3 Claims, 9 Drawing Sheets

(51) Int. Cl.
*B21D 22/22* (2006.01)
*B21D 24/02* (2006.01)

(58) Field of Classification Search
USPC ..... 72/343, 349
See application file for complete search history.

(56) References Cited

U.S. PATENT DOCUMENTS

| | | | | |
|---|---|---|---|---|
| 9,908,164 | B2 * | 3/2018 | Ramirez Fernandez | B21D 22/22 |
| 2015/0082853 | A1 * | 3/2015 | Ramirez Fernandez | B21D 22/28 72/349 |
| 2015/0336152 | A1 | 11/2015 | Yamagata et al. | |
| 2017/0128998 | A1 | 5/2017 | Nakamura et al. | |

FOREIGN PATENT DOCUMENTS

| | | |
|---|---|---|
| JP | 2016-002552 | 1/2016 |
| JP | 6305649 | 4/2018 |
| WO | WO 2014/109263 | 7/2014 |

OTHER PUBLICATIONS

International Search Report and Written Opinion, counterpart International Appl. No. PCT/JP2017/006364, with partial English translation (dated Apr. 11, 2017) (8 pages).
Notification of Reasons for Refusal, counterpart Japanese App. No. 2017-524060, with English translation (dated Dec. 28, 2017) (6 pages).
Decision to Grant a Patent, counterpart Japanese App. No. 2017-524060, with English translation (dated Feb. 14, 2018) (6 pages).

* cited by examiner

[FIG. 1]
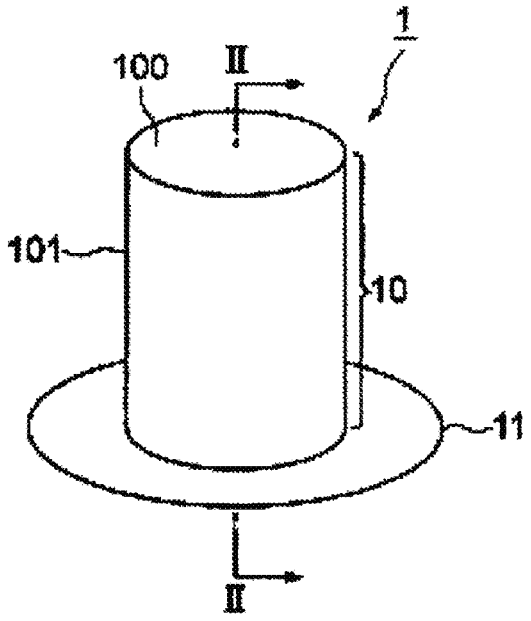

[FIG. 2]
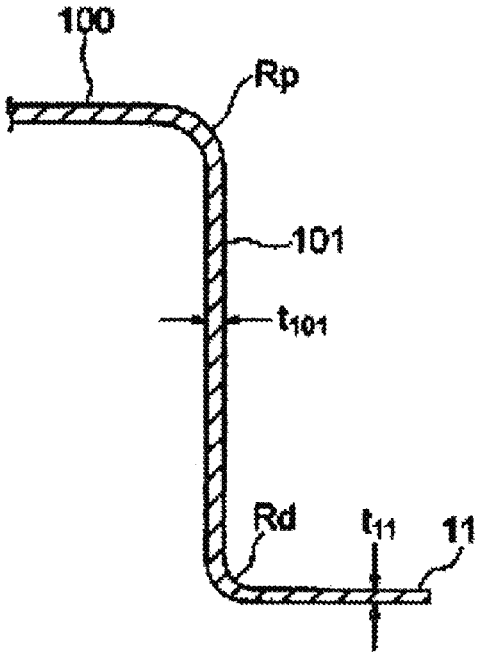

[FIG. 3]
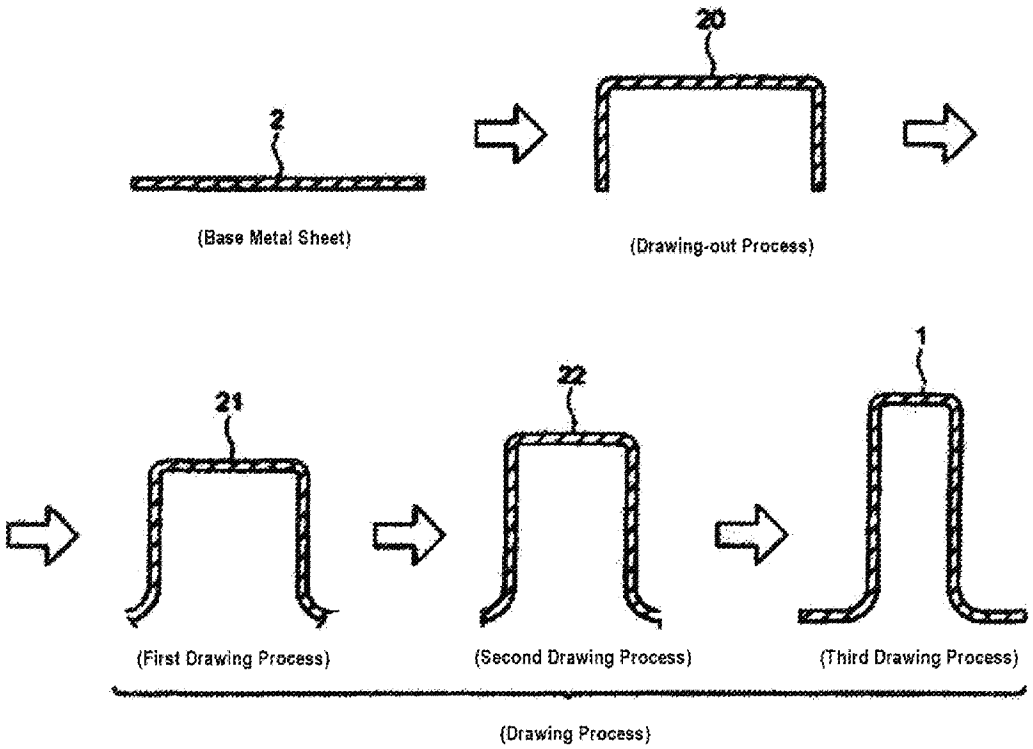

[FIG. 4]
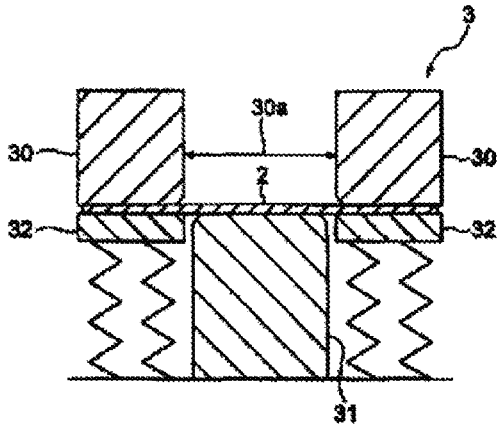

[FIG. 5]
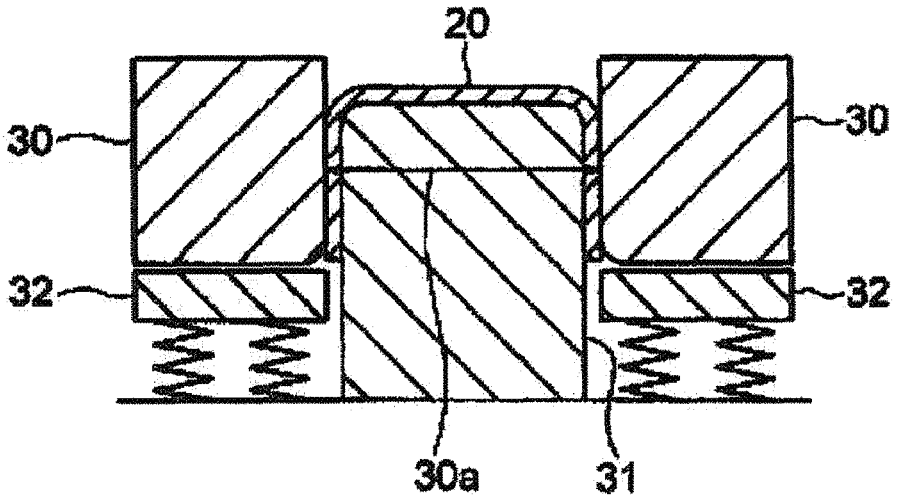

[FIG. 6]
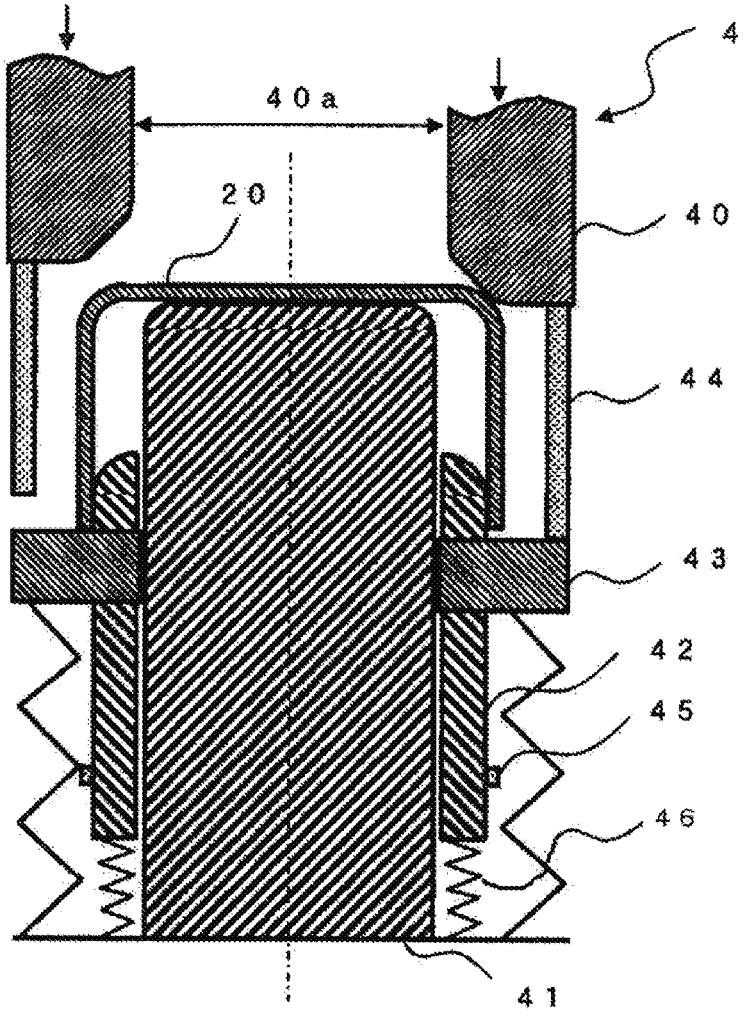

[FIG. 7]
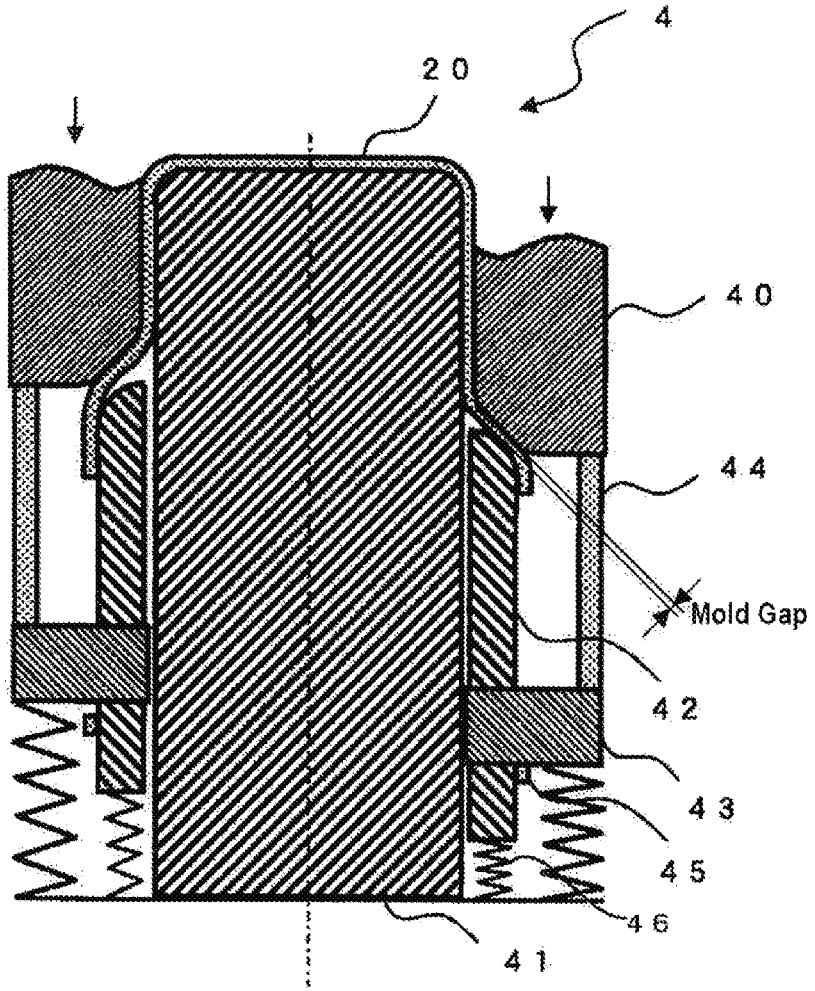

[FIG. 8]
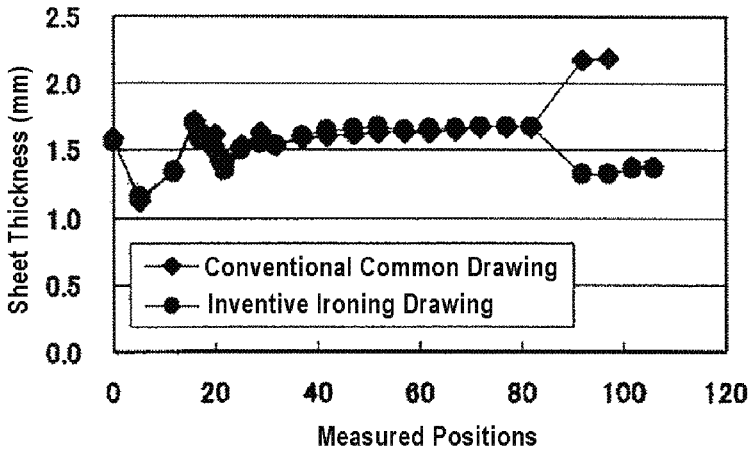

[FIG. 9]
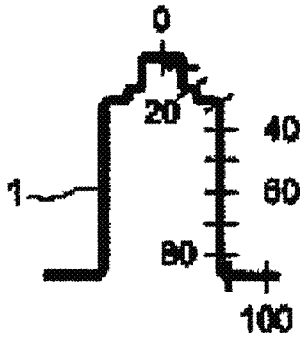

MOLDED MATERIAL PRODUCTION METHOD AND MOLDED MATERIAL

The present application is a U.S. National Stage of PCT International Patent Application No. PCT/JP2017/006364, filed Feb. 21, 2017, which claims priority to JP Application No. 2016-033361, filed Feb. 24, 2016, both of which are hereby incorporated herein by reference.

TECHNICAL FIELD

This invention relates to a method for producing a molded material including a tubular body and a flange formed at an end portion of the body, and also relates to a molded material.

BACKGROUND ART

As disclosed, for example, in non-patent document 1, a molded material including a tubular body and a flange formed at an end portion of the body is produced by performing a drawing process. The drawing process forms the body by drawing a base metal sheet, so that the thickness of the body is lower than that of the base sheet. On the other hand, a region of the metal sheet corresponding to the flange shrinks as a whole in response to the formation of the body, so that the thickness of the flange is higher than that of the base sheet. Hereinafter, the base material may be referred to as a "blank".

The molded material as described above may be used as a motor case disclosed, for example, in patent document 1 as described below. In this case, the body is expected to function as a shielding material for preventing magnetic leakage to the outside of the motor case. Depending on motor structures, the body is also expected to function as a back yoke of a stator. The performance of the body as the shield material or back yoke is improved as the thickness of the body increases. Therefore, when a molded material is produced by drawing, as described above, a base metal sheet with a thickness larger than the required thickness of the body is selected taking into account the reduction in thickness of the body caused by the drawing process. Meanwhile, the flange is often used for mounting the motor case on a mounting object. Therefore, the flange is expected to have a certain strength.

CITATION LIST

Patent Document

Patent Document 1: Japanese Patent Application Publication No. 2013-51765 A.

Non-Patent Document

Non-patent Document 1: Masao Murakawa, et. al., "Basics of Plastic Processing", First Edition, SANGYO-TOSHO Publishing Co. Ltd., Jan. 16, 1990, pp. 104 to 107.

SUMMARY OF INVENTION

Technical Problem

However, the conventional method for producing the molded material as described above produces the molded material including the tubular body and the flange formed at the end portion of the body by the drawing process, so that the thickness of the flange is larger than that of the base sheet. For this reason, the flange may become unnecessarily thicker over a thickness required for obtaining the expected performance of the flange. This means that the molded material becomes unnecessarily heavy, which cannot be ignored in applications in which weight reduction is required, such as motor cases.

On the other hand, in a multi-stage drawing process, when a change in diameter reduction of the flange before and after the drawing process is large, in other words, when a diameter of the flange after the drawing process becomes significantly smaller than the diameter of the flange before the drawing process, the lower thickness of the flange after the drawing process may generate wrinkles and/or buckling in the flange. The wrinkles and/or buckling may cause cracks during the subsequent drawing process.

In such a case, a drawing process using a drawing sleeve may be carried out in order to prevent the wrinkles and/or buckling. However, the drawing process is carried out by sandwiching the flange between a die and the drawing sleeve, so that a tensile stress will act on the body, causing a decrease in thickness of a circumferential wall of the body.

The present invention has been made to solve the above problems. An object of the present invention is to provide a method for producing a molded material and the molded material, which can avoid unnecessary thickening of the flange, reduce a weight of the molded material and achieve size reduction of the base metal sheet.

Solution to Problem

The present invention relates to a method for producing a molded material, the molded material comprising a tubular body and a flange formed at an end portion of the body, the molded material being produced by performing at least two molding processes on a base metal sheet, wherein the at least two molding processes comprise at least one drawing-out process and at least one drawing process performed after the drawing-out process; wherein the drawing-out process is carried out using a mold that comprises a punch and a die having a pushing hole; wherein a first drawing process among the at least one drawing process is carried out using a mold comprising a die and a drawing sleeve; wherein the first drawing process is carried out on a region corresponding to the body of the molded material, while opening the die and the drawing sleeve; and wherein an ironing process is performed on a region corresponding to the flange of the molded material, while keeping a constant interval of a mold gap between the die and the drawing sleeve.

An ironing ratio of the ironing process in the method for producing the molded material according to the present invention may be −35% or more and 50% or less.

Further, the first drawing process is carried out using a mold, the mold comprising: the drawing sleeve having the die and a stopper; and a lifter plate, and the interval of the mold gap to be kept constant may be determined by a position of the stopper along an axial direction of the drawing sleeve.

Further, the interval of the mold gap to be kept constant may be set to the same value as a thickness of the flange of the molded material.

The present invention relates to a molded material producable or produced by carrying out at least two molding processes on a base metal sheet, the molded material comprising: a tubular body; and a flange formed at an end portion of the body, wherein the at least two molding processes comprise at least one drawing-out process and at least one drawing process performed after the drawing-out process; and wherein a thickness of the flange of the molded material may be lower than that of the base metal sheet.

The present invention also relates to a molded material producable or produced by carrying out at least two molding processes on a base metal sheet, the molded material comprising a tubular body; and a flange formed at an end portion of the body, wherein the at least two molding processes comprise at least one drawing-out process and at least one drawing process performed after the drawing-out process; and wherein a thickness of the flange of the molded material may be lower than that of a circumferential wall of the body.

Advantageous Effects of Invention

According to the method for producing the molded material and the molded material according to the present invention, the ironing process occurs on the region corresponding to the flange of the final molded material during the first drawing process, by performing the molding while keeping the constant interval of the mold gap between the die and the drawing sleeve after the time when the region corresponding to the flange of the final molded material reaches the closest portion between the die and the drawing sleeve, by controlling the interval of the mold gap between the die and the drawing sleeve. As a result, wrinkles and buckling can be prevented, and an unnecessary increase in the thickness of the flange can be avoided so that the weight of the molded material can be reduced. This configuration is particularly useful for various applications in which weight reduction is required, such as motor cases.

BRIEF DESCRIPTION OF DRAWINGS

FIG. 1 is a perspective view showing a molded material produced by a method for producing a molded material according to Embodiment 1 of the present invention.

FIG. 2 is a sectional view taken along the line II-II in FIG. 1.

FIG. 3 is an explanatory view illustrating a method for producing the molded material shown in FIG. 1.

FIG. 4 is an explanatory view illustrating a mold used in the drawing-out process shown in FIG. 3.

FIG. 5 is an explanatory view illustrating the drawing-out process performed with the mold shown in FIG. 4.

FIG. 6 is an explanatory view illustrating a mold used in the first drawing process show in FIG. 3.

FIG. 7 is an explanatory view illustrating a first drawing process performed with the mold shown in FIG. 6.

FIG. 8 is a graph showing a thickness distribution of a molded material produced by a method for producing a molded material according to the present embodiment.

FIG. 9 is an explanatory view showing the sheet thickness measured positions in the molded material shown in FIG. 8.

DESCRIPTION OF THE PREFERRED EMBODIMENTS

Embodiments of the present invention will be described below with reference to the drawings.

Embodiment 1

FIG. 1 is a perspective view showing a molded material 1 produced by a method for producing a mold material according to Embodiment 1 of the present invention. As shown in FIG. 1, the molded material 1 produced by the method for producing the molded material according to the present embodiment includes a body 10 and a flange 11. The body 10 is a tubular portion having a top wall 100 and a circumferential wall 101 that extends from an outer edge of the top wall 100. Depending on the orientation of the molded material 1 to be used, the top wall 100 may be referred to by other terms, such as a bottom wall. In FIG. 1, the body 10 is shown to have a perfectly circular sectional shape, but the body 10 may have another shape, for example, such as an elliptical sectional shape or angular tubular shape. The top wall 100 may be subjected to further processing. For example, a protrusion further projecting from the top wall 100 can be formed. The flange 11 is a sheet portion formed on an end portion (an end of the circumferential wall 101) of the body 10.

FIG. 2 is a sectional view taken along the line II-II in FIG. 1. As shown in FIG. 2, a sheet thickness $t_{11}$ of the flange 11 is lower than a sheet thickness $t_{101}$ of the circumferential wall 101 of the body 10. The reason for this is that the ironing process is performed on a region of corresponding to the flange 11 of a base metal sheet 2 (see FIG. 3), as will be described in detail below. As used herein, the sheet thickness $t_{11}$ of the flange 11 means an average value of the sheet thickness of the flange 11 from a lower end of a lower side shoulder portion Rd between the circumferential wall 101 and the flange 11 to an outer end of the flange 11. Similarly, the sheet thickness $t_{101}$ of the circumferential wall 101 means an average value of the sheet thickness of the circumferential wall 101 from an upper end of the lower side shoulder portion Rd to a lower end of an upper side shoulder portion Rp.

FIG. 3 is an explanatory view illustrating the method for producing the molded material 1 shown in FIG. 1. The method for producing the molded material according to the present invention produces the molded material 1 by performing at least two molding processes on a flat base metal sheet 2. The at least two molding processes include at least one drawing-out process and at least one drawing process performed after the drawing-out process. In the method for producing the molded material according to this embodiment, the molded material 1 is produced by one drawing-out process and three drawing processes (first to third drawing processes). Various metal sheets, such as cold-rolled steel sheets, stainless steel sheets, and plated steel sheets based on these sheets, can be used as the base metal sheet 2.

FIG. 4 is an explanatory view illustrating a mold 3 used in the drawing-out process shown in FIG. 3, and FIG. 5 is an explanatory view illustrating the drawing-out process performed with the mold 3 shown in FIG. 4. As shown in FIG. 4, the mold 3 used in the drawing-out process includes a die 30; a punch 31; and a cushion pad 32. The die 30 is provided with a pushing hole **30*a* into which the base metal sheet 2 is pushed together with the punch 31. The cushion pad 32 is disposed at an outer peripheral position of the punch 31 so as to face an outer end surface of the die 30**.

As shown in FIG. 5, in the drawing-out process, an outer edge portion of the base metal sheet 2 is not completely constrained by the die 30 and the cushion pad 32, and the outer edge portion of the base metal sheet 2 is drawn out until it escapes from the constraint applied thereto by the die 30 and the cushion pad 32. The entire base metal sheet 2 may be pushed together with the punch 31 into the pushing hole **30*a*** and drawn out.

Next, FIG. 6 is an explanatory view illustrating a mold 4 used in the first drawing process in FIG. 3, and FIG. 8 is an explanatory drawing showing the first drawing by means of the mold 4 in FIG. 7. With reference to FIGS. 6 and 7, the movement of the mold and the state of processing during the first drawing process will be described in detail.

As shown in FIG. 6, the mold 4 used in the first drawing process includes a die 40; a punch 41; a drawing sleeve 42; a lifter plate 43; a killer pin 44; and a stopper 45. The die 40 is provided with a pushing hole 40*a* into which a first intermediate body 20 formed by the above drawing-out process is pushed together with the punch 41. The drawing sleeve 42 is disposed at an outer peripheral position of the punch 41 so as to face an outer end surface of the die 40.

Referring now to the figure as shown on the left side of the dashed line in FIG. 6, the first intermediate body 20 is placed on an upper surface of the lifter plate 43, and an inner peripheral surface of the first intermediate body 20 is in contact with an outer peripheral surface of the drawing sleeve 42. At this time, although the die 40 begins to descend, the outer end surface of the die 40 is not in contact with the first intermediate body 20, so that the drawing process of the first intermediate body 20 is not started yet. The tip of the killer pin 44 provided on the outer end surface of the die 40 does not reach the upper surface of the lifter plate 43.

Referring to the figure as shown on the right side of the dotted line in FIG. 6, the die 40 further descends to be in contact with the first intermediate body 20, whereby the drawing process begins. At this time, the tip of the killer pin 44 reaches the upper surface of the lifter plate 43, so that the die 40 descends and also pushes down the lifter plate 43. This will allow maintenance of the state where the flange tip of the first intermediate body 20 is not in contact with the upper surface of the lifter plate 43.

Next, referring to the figure as shown on the left side of the dotted line in FIG. 7, the die 40 continues to further descend, and the drawing process for responding to the pushing hole 40*a* of the die 40 is carried out on the body of the first intermediate body 20. At this time, a tip of a killer pin 44 reaches the upper surface of the lifter plate 43 and pushes down the lifter plate 43 as the die 40 descends. Therefore, the tip of the flange of the first intermediate body 20 which is subjected to the drawing process is not in contact with the upper surface of the lifter plate 43 and is in an uplifting state. Although the body of the first intermediate body 20 is being pushed into the pushing hole 40*a* due to relative motion between the die 40 and the punch 41, the tip of the flange is uplifting, so that any compressive stress in the upward direction is not applied to the circumferential wall of the body. Further, the gap between the die 40 and the drawing sleeve 42 is open, and a region corresponding to an outer edge of the first intermediate body 20 does not reach a state where the region is sandwiched by the die 40 and the drawing sleeve 42.

According to the figure as shown on the right side of the dotted line in FIG. 7, the die 40 further continue to descent, so that the lower surface of the lifter plate 43 will be brought into contact with the stopper 45 provided on the outer peripheral surface of the drawing sleeve 42. The lower surface of the lifter plate 43 is brought into contact with the stopper 45 provided on the outer peripheral surface of the drawing sleeve 42, whereby, hereafter, the drawing sleeve 42 will descend in synchronization with the die 40. Further, the interval of the mold gap between the die 40 and the drawing sleeve 42 will be constant. In this case, since the interval of the mold gap is provided so as to be equal to the thickness of the flange 11 of the final molded material 1, the region corresponding to the flange 11 of the final molded material 1 can be subjected to an ironing process.

Thus, according to the method for producing the molded material of the present invention, in the first drawing process, the timing for starting the ironing process on the region corresponding to the flange 11 of the final molded material 1 can be determined based on abutting of the lifter plate 43 against the stopper 45.

Further, the interval of the mold gap between the die 40 and the drawing sleeve 42 can be determined by the position of the stopper 45 along the axial direction of the drawing sleeve 42.

As shown on the right side of the dotted line in FIG. 7, when the drawing process is carried out on the body of the first intermediate body 20 in the first drawing process, the diameter of the flange does not change. Therefore, in this case, the gap between the die 40 and the drawing sleeve is open so that the outer edge of the first intermediate body 20 is not sandwiched. This will allow suppression of a decrease in the thickness of the circumferential wall of the body.

On the other hand, as shown on the right side of the dotted line in FIG. 7, when the drawing process is carried out on the outer edge of the first intermediate body 20, the diameter of the flange is decreased. In this case, generation of wrinkles and/or buckling can be prevented by molding the region corresponding to the flange while keeping the constant interval of the mold gap between the die 40 and the drawing sleeve 42.

It should be noted that before the lifter plate 43 abuts against the stopper 45, the die 40 and the drawing sleeve 42 will sandwich the region corresponding to the flange 11 of the final molded material 1 in the first intermediate body 20. At this time, sufficient upward pressure must be applied to the drawing sleeve 42 such that the drawing sleeve 42 does not descend until the lifter plate 43 abuts against the stopper 45. Specifically, this can be achieved by providing an urging member 46 such as a spring at a lower portion of the drawing sleeve, and then adjusting its strength, or the like.

The second drawing process and the third drawing process shown in FIG. 3 can be carried out using a conventional mold (not shown). In the second drawing process, the drawing process is further performed on a region of a second intermediate body 21 (see FIG. 3) formed in the first drawing process, the region corresponding to the body 10. The third drawing process corresponds to a re-striking process, in which the ironing process is performed on a region of a third intermediate body 22 (see FIG. 3) formed in the second drawing process, the region corresponding to the body 10.

In the first to third drawing processes, shrinkage occurs in the region corresponding to the flange 11, and an increase in the thickness occurs in this region. Therefore, the ironing ratio in the first drawing process may be set so as to be equal to or less than the thickness of the flange 11 of the final formed material 1, taking an increased amount of the thickness into account. It should be noted that the ironing ratio can be adjusted as needed by changing the interval of the mold gap between the die 40 and the drawing sleeve 42 in the drawing process. By sufficiently reducing the sheet thickness of the region corresponding to the flange 11 in the first drawing process, the sheet thickness $t_{11}$ of the flange 11 can be decreased as compared with the sheet thickness $t_{101}$ of the circumferential wall 101 of the body 10, in the final molded material 1.

Examples

Next, Examples will be described. The present inventors prepared a round sheet having a thickness of 1.8 mm and a diameter of 116 mm and formed by conducting Zn—Al—Mg plating on a common cold-rolled steel sheet, as the base metal sheet 2. The drawing-out process was then carried out under the following processing conditions. Here, the Zn—Al—Mg alloy plating was applied onto both surface of the steel sheet, and a plating coverage was 90 g/m$^2$ for each surface. Here, the ironing ratio was set by changing the interval of the mold gap between the die 40 and the drawing sleeve 42 by adjusting the position of the stopper 45 attached to the drawing sleeve 42.

Ironing ratio of region corresponding to flange 11: −50% to 60%;

Tip angle of die 40: 45°;

Shoulder radius of drawing sleeve 42: 5 mm;

Press oil: TN-20; and

Material of die and punch: SKD 11 (HRC 60).

<Evaluation of Ironing Ratio>

Table 1 shows a relationship between the ironing ratio and the flange molding evaluation. Here, the average thickness of the flange of the first intermediate body was 2.0 mm.

TABLE 1

| Ironing Ratio (%) | Mold Gap (mm) | State of Flange | Molding Evaluation |
|---|---|---|---|
| −50 | 3.0 | Wrinkles, Buckling | x |
| −35 | 2.7 | Good | ○ |
| −20 | 2.4 | Good | ○ |
| 0 | 2.0 | Good | ○ |
| 20 | 1.6 | Good | ○ |
| 35 | 1.3 | Good | ○ |
| 50 | 1.0 | Good | ○ |
| 60 | 0.8 | Cracking | x |

Average Sheet Thickness of First Intermediate Body: 2.0 mm

When the interval of the mold gap was 3.0 mm, the ironing ratio was −50%. In this case, a gap of a closest portion between the die and the drawing sleeve was larger, so that wrinkles and buckling were generated in the flange. Further, when the interval of the mold gap was 0.8 mm, the ironing ratio was 60%, and cracking occurred during the molding so that the molding was not possible. Only in the range of the ironing rate of from −35% to 50%, the molding was possible without wrinkles, buckling and cracking.

<Ironing Ratio>

The ironing ratio is as represented by the following equation (1). Here, a value of the sheet thickness of the flange of the first intermediate body can be used as the sheet thickness before ironing, and a value of the interval of the mold gap can be used as the sheet thickness after ironing.

$$\text{Ironing Ratio (\%)} = \frac{\text{Sheet thickness before ironing} - \text{Sheet thickness after ironing}}{\text{Sheet thickness before ironing}} \times 100 \quad (1)$$

<Sheet Thickness of Flange>

Next, FIG. 8 is a graph showing the sheet thickness distribution of the molded material produced from the first intermediate body. FIG. 9 is an explanatory view showing the sheet thickness measured positions in FIG. 8.

When the drawing process, among the first drawing process, is carried out on the region corresponding to the body of the molded material, the gap between the die and the drawing sleeve is opened so as not to sandwich the material, thereby suppressing a decrease in the sheet thickness of the circumferential wall. It is thus found that at the timing when the drawing process progresses and the region corresponding to the flange of the molded material reaches the closest portion between the die and the drawing sleeve, the interval of the mold gap between the die and the drawing sleeve is hereafter kept constant to carried out the molding, so that the sheet thickness of the flange of the final molded material can be decreased. When the molded material which was subjected to the drawing-out process involving the ironing process (Inventive Example) and the molded material subjected to the conventional common drawing process (Comparative Example) had the same external dimensions, the weight of the Inventive Example was about 10% less than the weight of the Comparative Example.

When the drawing-out process involving the ironing is carried out, the region corresponding to the flange 11 of the first intermediate body 20 is stretched. In order to form the molded material subjected to the drawing-out process involving the ironing (Inventive Example) and the molded material subjected to the conventional common drawing process (Comparative Example), both of which have the same external dimensions, either a smaller base metal sheet 2 may be used taking into consideration, in advance, an amount of stretching the region corresponding to the flange 11, or an unnecessary portion of the flange 11 may be trimmed.

In such a method for producing the molded material and the molded material produced thereby, the drawing process involves an ironing process performed on the region corresponding to the flange 11 of the first intermediate body 20 by pushing the first intermediate body 20 together with the punch 41 into the pushing hole 40*a*. Therefore, the wrinkles and/or buckling can be prevented, the sheet thickness of the flange 11 can be prevented from becoming unnecessarily thicker, and the weight of the molded material 1 can be reduced. This configuration is particularly useful for applications in which weight reduction of the molded material and size reduction of the base metal sheet are required, such as motor cases.

Further, the ironing ratio of the ironing process performed during the drawing process is −35% or more and 50% or less, and therefore the generation of wrinkles, buckling and cracking can be avoided.

Furthermore, when the drawing process is performed on the region corresponding to the body, the gap between the die 40 and the drawing sleeve 42 is opened so as not to sandwich the material, thereby suppressing a decrease in the sheet thickness of the circumferential wall, and at the timing when the region corresponding to the flange of the first intermediate body reaches the closest portion between the die 40 and the drawing sleeve, the molding is carried out while keeping the constant interval of the mold gap between the die 40 and the drawing sleeve 42, whereby the generation of wrinkles and/or buckling in the region corresponding to the flange can be avoided.

Further, although the present embodiment illustrates that the three drawing processes are performed, the number of the drawing processes may be changed, as needed, according to the size and required dimensional accuracy of the molded material.

DESCRIPTION OF REFERENCE NUMERALS

1 molded material

10 body

100 top wall

101 circumferential wall

11 flange
2 base metal sheet
20 first intermediate body
3 mold
30 die
30*a* pushing hole
31 punch
31*a* width variation portion
40 die
40*a* pushing hole
41 punch
42 drawing sleeve
43 lifter plate
44 killer pin
45 stopper
46 urging member

What is claimed is:

1. A method for producing a molded material, the molded material comprising a tubular body and a flange formed at an end portion of the body, the method comprising:

performing at least one drawing-out process on a base metal sheet to form a first intermediate body from the base metal sheet, wherein the at least one drawing-out process is carried out using a first mold that comprises a punch and a first die having a pushing hole;

performing one or more drawing processes performed after the at least one drawing-out process, completion of the one or more drawing processes resulting in the molded material from the first intermediate body, wherein a first drawing process of the one or more drawing processes is carried out using a second mold comprising a second die and a drawing sleeve;

wherein the first drawing process is carried out on a region that corresponds to the body of the molded material upon the completion of the one or more drawing processes, while a gap between the second die and the drawing sleeve is open so that an outer edge of the first intermediate body is not sandwiched therebetween;

wherein the first drawing process further includes an ironing process performed on a region that corresponds to the flange of the molded material upon completion of the one or more drawing processes, while keeping a constant interval of the gap between the second die and the drawing sleeve, the second die and the drawing sleeve sandwiching the region that corresponds to the flange; and wherein the second mold comprises a stopper and a lifter plate, and the constant interval of the gap is determined by a position of the stopper along an axial direction of the drawing sleeve.

2. The method for producing the molded material according to claim 1, wherein an ironing ratio of the ironing process is −35% or more and 50% or less.

3. The method for producing the molded material according to claim 1, wherein the constant interval of the gap is set to the same value as a thickness of the flange of the molded material.

* * * * *